United States Patent [19]

Burchfield et al.

[11] 4,441,985

[45] Apr. 10, 1984

[54] PROCESS FOR SUPPLYING THE HEAT REQUIREMENT OF A RETORT FOR RECOVERING OIL FROM SOLIDS BY PARTIAL INDIRECT HEATING OF IN SITU COMBUSTION GASES, AND COMBUSTION AIR, WITHOUT THE USE OF SUPPLEMENTAL FUEL

[75] Inventors: James E. Burchfield, Scotch Plains; Robert C. Green, Berkley Heights, both of N.J.

[73] Assignee: Exxon Research and Engineering Co., Florham Park, N.J.

[21] Appl. No.: 355,850

[22] Filed: Mar. 8, 1982

[51] Int. Cl.[3] ..... C10G 1/00; C10B 53/06; C10B 49/06

[52] U.S. Cl. ..... 208/11 R; 208/8 R; 201/32

[58] Field of Search ..... 208/8 R, 11 R; 201/28, 201/29, 32

[56] References Cited

U.S. PATENT DOCUMENTS

| | | | |
|---|---|---|---|
| 2,814,587 | 11/1957 | Van Dijck | 208/11 R |
| 3,483,115 | 12/1969 | Haddad et al. | 208/11 R |
| 3,560,369 | 2/1971 | Rowland et al. | 201/32 X |
| 3,573,194 | 3/1969 | Hopper et al. | 208/11 R |
| 3,644,193 | 2/1972 | Weggel et al. | 208/11 R |
| 3,668,077 | 6/1972 | Ban | 201/32 X |
| 4,039,427 | 8/1977 | Ban | 208/11 R |
| 4,058,905 | 11/1977 | Knight | 208/11 R X |
| 4,082,645 | 4/1978 | Knight et al. | 208/11 R |
| 4,133,741 | 1/1979 | Weichman et al. | 208/11 R |
| 4,218,304 | 8/1980 | Styring, Jr. | 208/8 R |
| 4,222,850 | 9/1980 | Matthews | 208/11 |

*Primary Examiner*—Delbert E. Gantz
*Assistant Examiner*—Glenn A. Caldarola
*Attorney, Agent, or Firm*—Llewellyn A. Proctor

[57] ABSTRACT

A process for retorting an organic oil-bearing solid, notably an oil shale, wherein the heat requirements of the retorting are supplied by the partial indirect heating of internally generated, or in situ combustion gases, and the combustion air, to form a by-product gas which can be burned with air in furnaces without necessity of using supplemental fuel.

5 Claims, 3 Drawing Figures

BASIC PRIOR ART CONFIGURATION OF TRAVELING GRATE RETORT USING DIRECT HEATING

PRIOR ART CONFIGURATION OF TRAVELING GRATE RETORT USING INDIRECT HEATING

PROCESS IMPROVEMENT OF TRAVELING GRATE RETORT USING PARTIAL INDIRECT HEATING

PROCESS FOR SUPPLYING THE HEAT REQUIREMENT OF A RETORT FOR RECOVERING OIL FROM SOLIDS BY PARTIAL INDIRECT HEATING OF IN SITU COMBUSTION GASES, AND COMBUSTION AIR, WITHOUT THE USE OF SUPPLEMENTAL FUEL

BACKGROUND OF THE INVENTION (A) Field of the Invention

This invention relates to a process for retorting an organic oil-bearing solid, notably an oil shale, wherein the heat requirements of the retorting are supplied by the partial indirect heating of internally generated, or in situ combustion gases, and the combustion air, with the production of a by-product gas stream having a heating value high enough to be useful as a fuel.

(B) Description of the Prior Art

Many retorting processes, such as the traveling grate and gas combustion processes, provide heat for retorting organic oil-bearing solids, notably oil shales, by combustion of gas and/or organic residues (i.e., coke-like materials) which remain on the solids after pyrolysis.

Typically oil is recovered from such oil-bearing solids, or shales, by retorting the solids, or shales, on traveling, or circular, grate retorts (traveling grate retorts). Retorts within which such processes are conducted include, or are constituted of, a series of zones, typically a pyrolysis zone, an organic residue combustion zone, and cooling zones, typically one or a series of cooling zones. In such processes, e.g., a particulate coarse raw shale is laid down on a grate, and pyrolysis is carried out by contacting the shale with a hot non-reactible, non-oxygen containing flue gas which is generated by burning some of the low Btu product gas in an external combustor. The combustion gases are quenched with a part of the in situ generated product gas to moderate the temperature to a satisfactory level for pyrolysis. The hot flue gas is passed downwardly through the bed of shale, and grate, and the shale heated, while the flue gas is cooled. The flue gas, which carries the shale oil and water vapor, is removed from the pyrolysis zone and passed to a product recovery section located externally of the pyrolysis zone. In the organic residue combustion zone, the organic residue carried by the shale is burned to supply additional process heat. Air, usually diluted with recycle gas or steam to reduce oxygen concentration to moderate temperatures, is introduced into the organic residue combustion zone. The oxygen in the air combusts the organic residue on the retorted shale, this heating the gas. The gas, heated by combustion, flows downwardly, heating the unretorted shale to retorting temperature, the oil and gas released by pyrolysis being swept downwardly with the gas and cooled.

The gases from the pyrolysis and organic residue zones are cooled and processed through product recovery equipment to recover product shale oil. The separated low Btu gas is used as process fuel and dilution gas after a portion has been preheated.

Whereas such process has achieved some success, it is not generally possible to operate the retort to produce a product gas with adequate heating value for use as fuel in process heaters, unless rich shales are used as feeds. A major difficulty of this process is that the pyrolysis gas is comingled with combustion products and nitrogen from the combustion air. Thus, the heating value of the product gas depends upon the shale richness and the heat requirement for the process. The richness of the shale thus affects heating value through the amount of gas released by retorting. The richer the shale, the more pyrolysis gas is released. The heat requirements for the process affects the quality by setting the amount of oxygen needed to supply heat through combustion of gas and organic residue. The larger the heat requirements of the process, the more oxygen is needed. The more oxygen is needed the greater the consumption of pyrolysis gas, and the greater the dilution of pyrolysis gas with nitrogen and combustion products, this thereby reducing the heating value of the gas. Moisture content can add significantly to the heat requirements for the process. Thus, lean, wet shales can produce gas products with heating value unsatisfactorily low for many fuel uses, in some cases, as low as 40 Btu/SCF. For lean shales with high moisture content, the heating value of the products may be unsatisfactorily low for direct combustion in furnaces, boilers, process heaters and other combustion devices. Supplemental fuel to increase the gas heating valve to the level that it will burn with a stable flame may be necessary. The cost of supplemental fuel to promote combustion of the product can be prohibitively expensive.

Improvement of this process has been made to increase the heating value of the product gas by providing an indirect heating scheme to produce a hotter gas for injection into the pyrolysis zone without the addition of diluting nitrogen and combustion products. In such improvement, supplemental fuel for use in furnaces burning the product gas is not required. In accordance with this process, the first zone combustor is eliminated, and pyrolysis heat is supplied by heating a recycle stream externally in a furnace, at sufficiently high temperature to produce retorting temperatures in the bed. The heating value of the product gas in such process configuration is thus higher than in that previously described because heat requirements for the pyrolysis zone do not involve the introduction of air into the heat carrying gas, this reducing the dilution of evolved gas products in that zone. In such process, the gas from the first zone may be combined with gas from the second zone, or each may go through product recovery steps separately. In accordance with the latter, a portion of the gas is used as a heat carrier through heating in an external furnace, and another portion is used as furnace fuel.

Albeit, this latter process scheme considerably improves the heating value of the product gas, high temperature, large heat duty and complex design features for the preheat furnace combine to make this process less than satisfactory. The process is too costly, and the thermal efficiency of the process is lowered. Even the capacity of the pyrolysis unit appears lessened because the furnace outlet gas temperature (and thereby the retort gas inlet temperature) may be reduced due to temperature limitations of furnace materials; and hydrocarbons that are present in the gas may be thermally cracked.

There is a need, and large incentives exist, for means of improving the heating value of such product gases to levels whereby shales, especially lean, wet shales, can be retorted to produce by-product gasses with high enough heating value that they can be burned in combustion devices with minimal, and preferably without the use of supplemental fuel.

OBJECTS OF THE INVENTION

It is, accordingly, the primary objective of the present invention to supply this need.

A particular object of this invention is to provide a process, especially an improved process of the types generally described, which utilizes external indirect heating of a heat carrying recycle stream to provide part of the process heat requirement, additional heat being supplied by combustion of a portion of the product gas with a reduced amount of air; the lessened amount of combustion air burning a smaller amount of the combustibles and decreasing the dilution due to combustion products and nitrogen from the air, thereby increasing the heating value of the product gas stream such that, with the added heat generated by burning the organic residue from the solids with an oxygen-containing gas, the heat requirements for the retorting process can be supplied while producing a gas with heating value sufficiently high that no use of supplemental fuel is required for its utilization.

SUMMARY OF THE INVENTION

These objects and others are accomplished in accordance with the present invention, a heat balanced process which utilizes indirect heating of low Btu recycle product gas, and combustion air, to supply a portion of the heat required in the pyrolysis zone, the balance of the heat being supplied by hot flue gas from external combustors and hot flue gas from the combustion of the organic residue.

In accordance with the present invention, as in previous practice, an organic oil-bearing solid, or oil shale is charged to a horizontal traveling grate and transported through a retort which contains a plurality of sectors, or zones, viz., a pyrolysis zone, an organic residue combustion zone, and one or more cooling zones, e.g., a series constituted of a first cooling zone and a second cooling zone, an external combustor wherein product gas generated from within the process is burned with air to supply heat for the pyrolysis zone, and a product recovery zone from which product oil and product gas produced in the pyrolysis and organic residue combustion zones are recovered. In the improved process, a process gas heater is employed to indirectly heat, and thereby increase the heat content of a gas stream, or streams, entering into the pyrolysis zone, these gases being used in the process to produce additional process heat. The indirect heating of the gas stream, or streams, reduces the amount of combustion required to achieve the gas temperatures necessary for pyrolysis. Dilution of the pyrolysis gas with combustion products, nitrogen and air, and depletion of combustible products are reduced, this increasing the heating value of the gas. The heat produced from this gas, with the added heat generated by burning the organic residue from the solids with air, or oxygen-containing gas is adequate to heat balance the process.

These and other features and advantages of the invention will be better understood by reference to the following more detailed description, and to the drawing to which reference is made.

BRIEF DESCRIPTION OF THE DRAWINGS

Referring to the drawing:

The figures schematically depict sectional side elevation views of travelling circular grate retorts.

FIG. 1 depicts a traveling grate retort, and process of operating a traveling grate retort using an external combuster to supply process heat, a basic prior art traveling grate retort or basic configuration over which the present process is an improvement.

FIG. 2 depicts a traveling grate retort, and process of operating a traveling grate retort, a prior art configuration which utilizes a heater for indirect heating of an in situ generated recycle gas stream which serves as a heat carrier; over which the present invention is an improvement.

Figure 1:
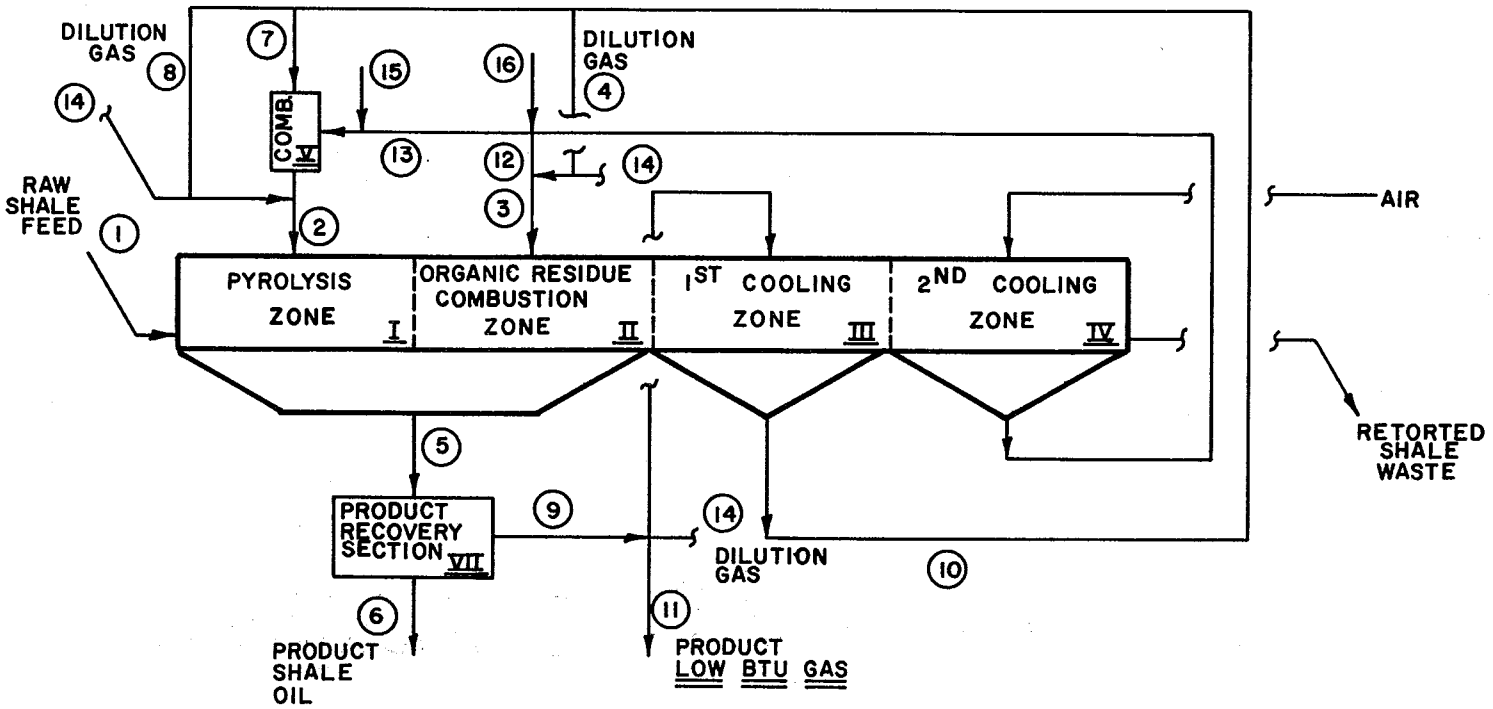
FIGS. 1 and 2 depict the prior art process schemes previously discussed so that the improved process depicted by reference to FIG. 3 can be better contrasted therewith.

DESCRIPTION OF SPECIFIC EMBODIMENTS (This Invention Being Contrasted with Prior Art)

Referring generally to all the several figures, there is described a typical traveling circular grate retort inclusive of a series of sections which provide a pyrolysis zone (I), an organic residue combustion zone (II), and cooling zones (III, IV). The retort depicted in FIGS. 1 and 3 also include a combuster (V), and those described by reference to FIGS. 2 and 3 include an external, indirect heater (VI). All of the figures include a product recovery section (VII). In the operation of such retorts, a particulate oil-bearing solid, suitably a raw shale feed is charged (1), to a gas permeable horizontally oriented, circular, or continuous travelling grate (not shown) supported upon suitable rollers (not shown) within the travelling circular grate retort. The forming bed of raw shale feed is, in this manner, transported in seriatim through the pyrolysis zone (I), organic residue combustion zone (II), first cooling zone (III), and second cooling zone (IV), and the retorted shale waste is then dumped from the retort after removal of the oil. Pyrolysis is conducted in zone (I) by contacting the bed of shale with a hot non-reactable gas (2), essentially devoid of oxygen. The hot flue gas (2) passes downwardly through the particulate bed of shale and it is cooled while the shale is heated. The top of the bed, exposed to higher temperatures, is heated to retorting temperature sooner than shale deeper in the bed. As the organic material is pyrolyzed, the oil and gas are swept downwardly along with the heat carrying gas. As the gas continues downwardly, it is cooled by shale at lower temperatures deeper in the bed. The oil vapor and a portion of the water vapor present begin to condense as a fine mist, and the condensate is carried out of the zone along with the gas (5) into the product recovery section (VII). The shale continues its travel on the grate, and as it does the high temperature zone penetrates deeper into the bed by heat transfer from the hot gas stream to the shale as the shale is carried into the organic residue combustion zone (II).

Continuing to refer to the process scheme defined by the severl figures, an organic residue or coke-like material remains on the retorted shale after pyrolysis of the shale within said pyrolysis zone (I), this representing a potential source for part of the process heat requirements. Accordingly, a hot oxygen-containing gas (3) is introduced within the organic residue combustion zone (II) wherein the shale is transported after the top part of the bed has been pyrolyzed. The oxygen combusts the organic residue on the retorted shale near the top of the bed, this releasing heat which raises the temperature of the heat carrying gas. In the burn, the oxygen is also depleted producing an essentially inert hot gas. At the front end of the zone, this occurs near the top of the bed because of the availability of oxygen and surface carbon. Toward the back end of the zone, the combustion front penetrates deeper into the bed because less surface carbon is available at the top of the bed. The gas, heated by combustion, flows downwardly, heating the unretorted shale deeper in the bed to retorting temperature. Again, the oil and gas released by pyrolysis are swept downwardly with the gas, and cooled. The gas cools to a lesser degree in the combustion zone (II) than in the pyrolysis zone (I) because the lower shale layers are hotter in the combustion zone (II) having been preheated in the pyrolysis zone (I).

The gases (5) from the first two zones, combined or separately, are cooled and processed in a product recovery section (VII) to recover oil mist from the gas as product shale oil (6) and low Btu gas (9).

Specific reference is made to FIG. 1. In accordance with this process scheme the hot flue gas (2) for use in the pyrolysis zone (I) is produced by burning some of the preheated (or unpreheated) low Btu gas production (7) with preheated (13), or unpreheated (15) air in combustor (V). The combustion gases are quenched with preheated (8), or unpreheated (14) dilution gas recovered from within the process to moderate the temperature to a satisfactory level for pyrolysis. It will be observed that a low Btu gas (9) is recovered from the product recovery section (VII), a portion thereof (11) being removed from the process which can be burned to supply process heat elsewhere. Another portion of the low Btu gas (10) is preheated in the first cooling zone (III), a part thereof (7) being burned in the combustor (V) with air (13) preheated by passage through cooling zone (IV), or unpreheated air (15), while another preheated (8) or unpreheated portion (14) thereof is used to quench and regulate the heat of reaction prior to injection of the combustion products into the pyrolysis zone (I). A portion of the preheated (4) or unpreheated (14) low Btu dilution gas is mixed, as suggested, with unpreheated (16) or preheated (12) air and the admixture injected (3) into the organic residue combustion zone (II) to burn the organic residue from the solids, the combustion products (5) from both the pyrolysis and organic residue combustion zones being injected into the product recovery (VII).

The difficulty with this process is that the product low Btu gas varies in heating value depending upon the richness of the shale and the heat requirement for the process. The richness of the shale affects heating value through the amount of gas released by retorting. The richer the shale, the more pyrolysis gas is released. The heat requirement for the process affects the quality by setting the amount of oxygen needed to supply heat through combustion of gas and organic residue. The larger the heat requirement, the more oxygen is needed. The more oxygen combusted the greater the depletion of combustibles and the greater the dilution of pyrolysis gas with nitrogen and combustion products, this reducing the heating value of the gas. Moisture content can add significantly to the heat requirements for the process. Thus, e.g., lean, wet shales can produce gas product with heating values unsatisfactorily low for many fuel uses, in some cases, as low as 40 Btu/SCF.

Figure 2:
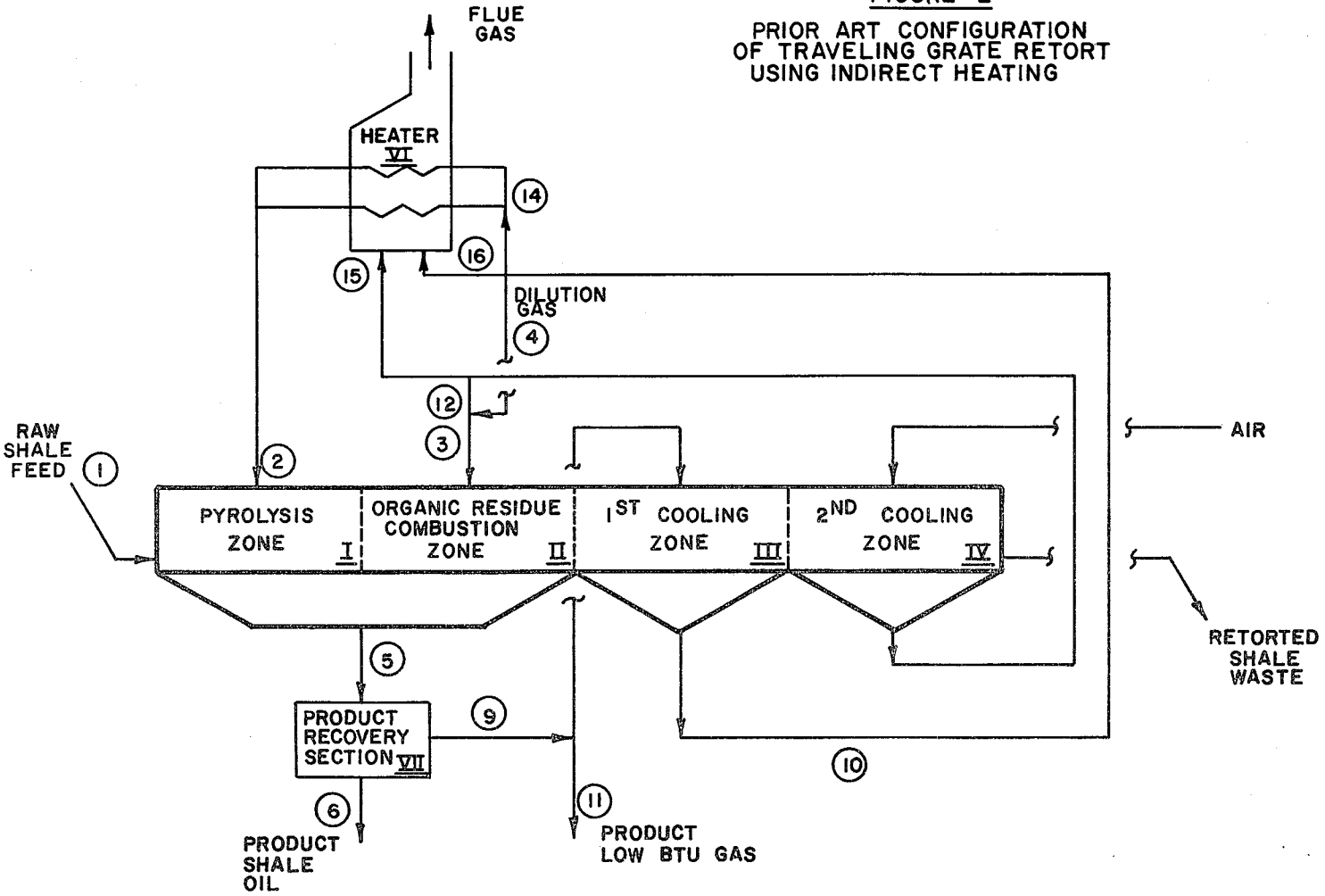

Direct reference is now made to FIG. 2, which shows a retort using a traveling grate configuration which uses indirect heating to produce hot gas for the pyrolysis zone (I). In this process scheme, the first zone combustor (V) of FIG. 1 is eliminated. The total heat required in the pyrolysis zone (I) is indirectly supplied by use of a portion of the recycle gas (14) as a heat carrier which is heated in an external furnace. The recycle stream (14) is thus externally heated in a furnace, at sufficiently high temperature to produce retorting temperatures in the bed. Heat for the furnace is supplied by burning a portion (16) of the low Btu gas (9) preheated (10) in the first cooling zone (III), with air (15) preheated in the second cooling zone (IV), the combustion products heat exchanging with furnace tubes through which the recycle stream (14) is passed prior to discharge from the furnace as flue gas. The heating value of the gas product in this configuration is higher than that obtained by the process described by reference to FIG. 1 because heat requirements for the first zone do not involve introduction of air into the heat carrying gas (2), the indirect heating thereby eliminating depletion of combustibles in the gas and reducing the dilution of the gas products evolved from that zone. The gas from the pyrolysis zone (I) may be combined with gas from the organic residue combustion zone (II), or each may be separately injected into the product recovery zone (VII).

While this process configuration improves the heating value of the gas product, high furnace outlet temperature, large heat duty and complex furnace design features combine to make this type of service too costly. Thermal efficiency is lowered. Capacity may also be reduced.

Figure 3:
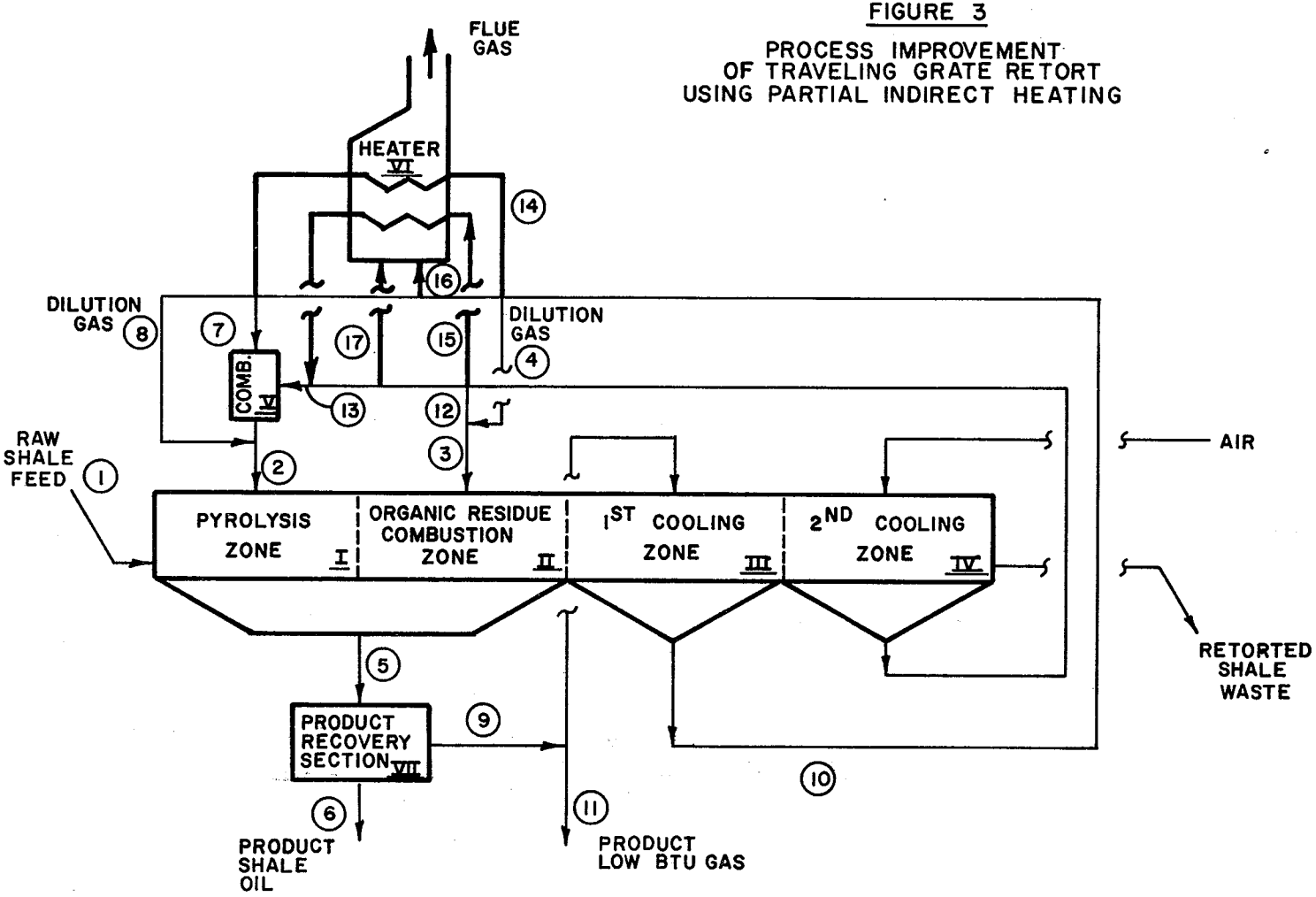
FIG. 3 depicts a traveling grate retort, and process of operating a traveling grate retort, the process improvement of the present invention, which utilizes partial indirect heating of an in situ generated recycle heat carrier gas stream, and an external combuster for supplying a portion of the process heat.

Specific reference is now made to FIG. 3. The process improvement of this invention is based on supplying a portion of the heat required in the pyrolysis zone (I) by indirect heat and the balance of the heat by combustion. A part of the process heat is thus supplied by heating the dilution, or recycle gs to mild temperature levels, and air to mild temperatures or higher levels, using these gases as heat carriers while reducing the amount of air used for the combustion. Shifting a part of the heat duty for the process to an indirect heater, permits heat addition to the process without depletion of the heating value of the product gas and dilution with combustion products. Thus, the low Btu gas heating value is improved. In this process, a portion of the heat of retorting for the pyrolysis zone (I) is supplied both by external heating in a furnace of a low Btu gas recycle stream (14) and air (15), heat for the furnace being supplied by combustion in the furnace of preheated low Btu product gas (16) and air (17) which is preheated in cooling zone (IV). Heat for the pyrolysis zone (I) is also provided by burning low Btu gas (7) constituted of a portion of an unpreheated (9) or preheated dilution (10), or heated recycle gas (14) and preheated air (13) constituted of air preheated in the second cooling zone (IV) or air (15) after heating in the heater (VI), the effluent of which can be quenched by a stream of unpreheated or partially preheated dilution, or recycle gas (8) as required for adjustment of the injection temperature of the heat carrying gas (2).

Indirect heat is supplied only to the extent required to produce low Btu gas with a heating value satisfactory for combustion with customary levels of preheat of about 600° F. Calculations have shown that low Btu gas from oil shale with a heating value of 110 Btu/SCF (GHV), or 103 Btu/SCF (GHV) can be satisfactorily burned under these conditions. Calculations have also shown that gas heating values in this range can be achieved with shale richnesses down to 70 l/t and a moisture level of 18% (on wet shale) if the process improvement of this invention is utilized. Furthermore, calculations show that heating values in this range can be achieved with moderate outlet temperatures on the process stream from the furnace, in the range of 1000° F. or less depending on the shale richness and heat requirements for the shale. Thus, cracking of process stream hydrocarbons is also greatly reduced in the furnace at the lower temperature. These factors affect considerably the design of furnace, reducing cost due to both lower temperatures and size.

The inlet gas temperature to the pyrolysis zone, moreover, is not limited to the furnace outlet temperature as it is in the process configuration described by reference to FIG. 2. Consequently, this process improvement does not reduce grate capacity. In addition, calculations show that oil recovery is further improved by reducing process combustion air. Increased thermal efficiency is an additional benefit from preheating recycle gas, particularly for wetter oil shales, as contrasted with the process configuration of FIG. 1 due to higher moisture contents resulting from the increased recycle gas rate. Consequently, the heat capacity of the gas is increased by promoting better heat transfer. Also, the gas dew point is raised, enhancing the recovery of heat from the water condensing in the lower, cooler layers of the bed.

The following are exemplary of the process of this invention.

EXAMPLES

The Table below illustrates the benefits of the invention over the usual process of FIG. 1 for Australian shales of two richnesses each containing about 18% water.

TABLE

| | Feed Quality | | | |
|---|---|---|---|---|
| | 24 gpt(1) | | 16.8 gpt(1) | |
| | Process Type | | | |
| | Base with No Preheater FIG. 1 | With Preheater for Partial Heat FIG. 3 | Base with No Preheater FIG. 1 | With Preheater for Partial Heat FIG. 3 |
| Product Gas, | | | | |
| Btu/SCF(2) | 95 | 110 | 47 | 110 |
| kSCF/ST(3) | 6.3 | 5.1 | 6.1 | 1.7 |
| kBtu/ST(3) | 595 | 568 | 289 | 185 |
| Oil Yield Wt. % Fischer Assay | 88.9 | 89.2 | 85.3 | 89.8 |
| Heat Duties kBtu/ST(3) | | | | |
| Combustor | 324 | 264 | 426 | 185 |
| Pre Heat Furnace | — | 67 | — | 259 |
| Total Process Fuel | 324 | 331 | 426 | 444 |

(1)Richness Fischer Assay, gallons per ton (gpt) on dry basis.
(2)Gross Heating Value (GHV), Btu's per Standard Cubic Foot (SCF), dry.
(3)ST = Short Tons.

It is necessary for a gaseous fuel to have a GHV of 110 Btu/SCF dry with conventional levels of preheat of about 600° F. to burn this fuel in furnaces/heaters and boilers without supplemental fuel. Richer shales with low moisture contents may produce product gas satisfactory as fuel. However, as can be seen in the above table, the high moisture content 24.0 gpt shale produces a gas with a GHV of only 95 Btu/SCF in the traveling grate process normal configuration. The invention utilizing a preheat furnace to supply part of the process heat requirements can increase the GHV to an acceptable level of 100 Btu/SCF dry as previously described. In achieving this higher GHV for the product gas, these calculated results show that only about 2% more process fuel is needed for 24 gpt shale. This additional requirement is due to thermal inefficiencies associated with furnace as compared to the grate. However, the additional requirement may in fact not result. The process of FIG. 3 will produce a higher dew point retort gas stream which upon recycle may give up more heat to the shale bed through condensation of water than the base configuration. This will tend to offset and reduce the indicated higher fuel requirement. Thus, for essentially no increase in process fuel an increase in product gas GHV to 110 Btu/SCF is achieved. At the same time, a smaller volume of product gas, about 16% less, is made thereby reducing compression costs. The total heat content of the product gas stream is reduced by less than 5%, but this heating value is due to naphtha fractions which are more readily recovery and upgraded to additional liquid oil product thereby contributing to the higher oil recovery.

For leaner shales, the results are even more dramatic. For a 16.8 gpt Australian shale the GHV of the product gas from the base configuration is only 47 Btu/SCF, an unsatisfactory level for use as fuel in furnaces, heaters, and boilers, without large amounts of supplemental fuel. Supplemental fuel costs for this low GHV fuel would be prohibitively costly. The desired GHV product gas can again be achieved by using the invention process shown in FIG. 3. The process heat requirements are only slightly higher than the base, about 4%. Again, the partial indirect process will produce a retort gas stream with a higher dew point. Thus, the recycle gas stream may give up more heat to the shale bed through condensation of water than the base configuration. This will tend to offset and reduce the indicated higher fuel requirement for the partial indirect process of FIG. 3. Thus, for essentially no increase in process fuel, product gas GHV can be increased from 47 to 110 Btu/SCF requiring no supplemental fuel for combustion. There is also a significant reduction in the amount of product gas made thereby substantially reducing compression costs. The total heat content of the gas is also reduced by about one third, but this heating value is due to naphtha fractions which are more readily recovered and upgraded to liquid oil product in the partial indirect configuration of FIG. 3. This higher oil recovery shows up as an increase of 4.5% in oil yield (expressed as a percent of Fischer Assay).

Having described the invention, what is claimed is:

1. In a process for the recovery of an organic oil from an organic oil-bearing solid wherein said solid, in particulate form, is transported through a series of zones inclusive of a pyrolysis zone, and wherein is included an organic residue combustion zone, one of more cooling zones, an external combustor wherein product gas generated from within the process is recycled and burned with an oxygen-containing gas to supply heat for the pyrolysis zone, and a product recovery zone from which product oil and product gas produced in the pyrolysis and organic residue combustion zones are recovered, pyrolysis is carried out in the pyrolysis zone by contacting the organic oil-bearing solid with a hot non-reactable gas essentially devoid of oxygen to remove from the solid a product organic oil and product gas, the oil-containing gas being injected into the product recovery zone, the hot non-reactable gas employed in the pyrolysis zone is generated in situ within the process by burning some of the product gas with an oxygen-containing gas in a combustor external to the pyrolysis zone, and the combustion gases quenched with a portion of the recycled product gas as dilution gas to moderate the temperature to a satisfactory level for injection into the pyrolysis zone, the solid, which contains an organic residue after removal of organic oil, is transported from the pyrolysis zone to the organic residue combustion zone and contacted with a recycle gas to which is added sufficient of an oxygen-containing gas to combust with the organic residue of the pyrolyzed solid to produce process heat, and the products of the combustion are injected into the product recovery zone, the product organic oil and product gas from the pyrolysis and organic residue combustion zones are separated into a product oil, and a product gas a portion of which is heated in a cooling zone of the series and recycled, a portion of the product gas burned with an oxygen-containing gas in said combustion zone and another portion of the product gas as dilution gas used to quench and moderate the temperature of the combustion products from the combustion zone to a satisfactory level for injection into the pyrolysis zone, the improvement comprising adding to the process an indirect heater, heating, in the external indirect heater, at least a portion of the recycled product gas, burning within the external combustor, an admixture of the hot recycled product gas from the external indirect heater and an external oxygen-containing gas indirectly preheated by heat generated from within the process to form a non-reactable gas mixture essentially devoid of oxygen, and injecting said mixture of burned gases into the pyrolysis zone to reduce the amount of combustion required for achieving the combustion gas temperature necessary for pyrolysis, to produce a gas product which can be burned with an oxygen-containing gas to supply process heat without necessity of using supplemental fuel.

2. The process of claim 1 wherein the indirect heat is supplied to the extent required to produce low BTU gas having a heating value satisfactory for combustion with preheat of about 600° F.

3. The process of claim 1 wherein the organic oil-bearing solid is oil shale, and the indirect heat is supplied to the extent required to produce low BTU gas having a heating value satisfactory for combustion with preheat of about 600° F.

4. The process of claim 1 wherein the organic oil-bearing solid is oil shale, and the oil shale is one having a shale richness down to 70 liters/ton and a moisture level ranging as high as 18%.

5. The process of claim 1 wherein the recycled product gas that is indirectly preheated within the external indirect heater is diluted with preheated or unpreheated dilution gas, prior to burning with the oxygen-containing gas.

* * * * *